US010056035B2

(12) United States Patent
Liu et al.

(10) Patent No.: US 10,056,035 B2
(45) Date of Patent: Aug. 21, 2018

(54) PIXEL CIRCUIT AND DRIVING METHOD THEREOF

(71) Applicant: AU OPTRONICS CORP., Hsin-Chu (TW)

(72) Inventors: Li-Wei Liu, Hsin-Chu (TW); Chien-Ya Lee, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 128 days.

(21) Appl. No.: 15/357,198

(22) Filed: Nov. 21, 2016

(65) Prior Publication Data

US 2017/0162118 A1 Jun. 8, 2017

(30) Foreign Application Priority Data

Dec. 7, 2015 (TW) ..... 104140986 A

(51) Int. Cl.
*G09G 3/3241* (2016.01)
*G09G 3/3233* (2016.01)

(52) U.S. Cl.
CPC ..... *G09G 3/3241* (2013.01); *G09G 3/3233* (2013.01); *G09G 2300/0819* (2013.01); *G09G 2300/0842* (2013.01); *G09G 2300/0852* (2013.01); *G09G 2300/0861* (2013.01); *G09G 2310/0262* (2013.01);
(Continued)

(58) Field of Classification Search
CPC .... G09G 3/3241; G09G 3/325; G09G 3/3233; G09G 3/3258; G09G 2310/0262; G09G 2310/061; G09G 2300/0861; G09G 2300/0852; G09G 2300/0842;
(Continued)

(56) References Cited

U.S. PATENT DOCUMENTS 8,502,757 B2 8/2013 Liu et al.
9,773,449 B2 * 9/2017 Lin ..... G09G 3/3233
(Continued)

FOREIGN PATENT DOCUMENTS

CN 101901576 A 12/2010
CN 102376251 A 3/2012
(Continued)

OTHER PUBLICATIONS

State Intellectual Property Office of the People's Republic of China , "Office Action", dated Sep. 4, 2017.

*Primary Examiner* — Darlene M Ritchie
(74) *Attorney, Agent, or Firm* — WPAT, PC

(57) ABSTRACT

A pixel circuit includes a first capacitor, an input unit, a driving unit, a first compensation unit, an organic light-emitting diode, a switch unit, a second compensation unit and a reset unit. The input unit is electrically connected to the first capacitor and the second compensation unit. The second compensation unit is electrically connected to the organic light-emitting diode. The first compensation unit is electrically connected to the first capacitor, the driving unit, the switch unit and the reset unit. The driving unit is electrically connected to the switch unit and the reset unit. The switch unit is electrically connected to the organic light-emitting diode. The pixel circuit is configured to generate a corresponding driving current according to a turn-on voltage of the organic light-emitting diode. A driving method of a pixel circuit is also provided.

5 Claims, 7 Drawing Sheets

(52) U.S. Cl.
CPC ..... *G09G 2310/061* (2013.01); *G09G 2320/0233* (2013.01); *G09G 2320/045* (2013.01)

(58) Field of Classification Search
CPC ..... G09G 2300/0819; G09G 2320/045; G09G 2320/0233
See application file for complete search history.

(56) References Cited

U.S. PATENT DOCUMENTS

| | | | | |
|---|---|---|---|---|
| 2011/0050659 | A1 | 3/2011 | Tsai et al. | |
| 2011/0157135 | A1 | 6/2011 | Lee et al. | |
| 2012/0038612 | A1 | 2/2012 | Chung et al. | |
| 2013/0043796 | A1* | 2/2013 | Ko | G09G 3/3233 315/151 |
| 2013/0335307 | A1 | 12/2013 | Guo et al. | |
| 2014/0312784 | A1* | 10/2014 | Yin | G09G 3/3208 315/172 |
| 2014/0354182 | A1 | 12/2014 | Liu et al. | |
| 2017/0061884 | A1* | 3/2017 | Chen | G09G 3/3233 |

FOREIGN PATENT DOCUMENTS

| | | |
|---|---|---|
| JP | 2007140488 | 6/2007 |
| TW | I252455 | 4/2006 |
| TW | I471842 | 2/2015 |

* cited by examiner

PIXEL CIRCUIT AND DRIVING METHOD THEREOF

TECHNICAL FIELD

The present disclosure relates to a pixel circuit, and more particularly to a pixel circuit of an organic light-emitting diode and a driving method thereof.

BACKGROUND

Compared with a liquid crystal display apparatus, an organic light-emitting diode display apparatus has some advantages such as self-luminosity, wide viewing angle, high contrast, fast response, etc., and therefore is suitable for the portable electronic devices sensitive to power consumption. In an organic light-emitting diode display apparatus, a pixel unit is used for displaying corresponding display data according to a driving current flowing through an organic light-emitting diode; wherein the driving current is generated by a driving transistor. However, the conventional pixel unit may not normally display the display data due to the declines of threshold voltage of the driving transistor, the external voltage or the luminous efficiency of the organic light-emitting diode itself; and consequently, a poor visual effect occurs.

SUMMARY

The present disclosure provides a pixel circuit, which includes a first capacitor, an input unit, a driving unit, a first compensation unit, an organic light-emitting diode, a switch unit, a second compensation unit and a reset unit. The first capacitor includes a first terminal and a second terminal. The input unit is electrically connected to the first terminal of the first capacitor. The input unit is configured to transmit display data to the first terminal of the first capacitor according to a first scan signal. The driving unit includes a first terminal, a second terminal and a control terminal. The control terminal of the driving unit is electrically connected to the second terminal of the first capacitor. The driving unit is configured to generate a driving current at the second terminal thereof according to a voltage at the second terminal of the first capacitor. The first compensation unit is electrically connected between the second terminal of the driving unit and the second terminal of the first capacitor. The first compensation unit is configured to convert a first voltage at the second terminal of the first capacitor into a second voltage according to a second scan signal. The organic light-emitting diode is configured to receive the driving current. The switch unit is electrically connected between the second terminal of the driving unit and a first terminal of the organic light-emitting diode. The switch unit is configured to transmit the driving current to the organic light-emitting diode according to a first control signal. The second compensation unit is electrically connected between the first terminal of the first capacitor and the first terminal of the organic light-emitting diode. The second compensation unit is configured to convert a third voltage at the first terminal of the first capacitor into a fourth voltage according to the second scan signal. The reset unit is electrically connected to the second terminal of the driving unit. The reset unit is configured to provide a reference voltage to the second terminal of the driving unit according to a second control signal.

The present disclosure further provides a driving method of a pixel circuit. The pixel circuit includes a first capacitor, an input unit, a driving unit, a first compensation unit, an organic light-emitting diode, a switch unit, a second compensation unit and a reset unit. The input unit is electrically connected to a first terminal of the first capacitor. The driving unit is electrically connected to a second terminal of the first capacitor. The first compensation unit is electrically connected between a second terminal of the driving unit and the second terminal of the first capacitor. The switch unit is electrically connected between the driving unit and the organic light-emitting diode and for receiving a first control signal. The second compensation unit is electrically connected between the first terminal of the first capacitor and the organic light-emitting diode. The reset unit is electrically connected to the second terminal of the driving unit and the first compensation unit and for receiving a second control signal. The driving method includes steps of: in a first period, turning on the first compensation unit and the second compensation unit according to a first scan signal and turning on the reset unit according to the second control signal thereby providing a reference voltage to the second terminal of the first capacitor; in a second period, turning off the reset unit, continuously turn on the first compensation unit and the second compensation unit, converting a voltage at the second terminal of the first capacitor to a first voltage according to an external high voltage provided by the driving unit, and making a voltage at the first terminal of the first capacitor equal to a turn-on voltage of the organic light-emitting diode; in a third period, turning on the input unit according to a second scan signal thereby transmitting display data to the first terminal of the first capacitor and pulling up the voltage at the second terminal of the first capacitor to a second voltage; and in a fourth period, turning on the switch unit according to the first control signal thereby transmitting a driving current generated by the driving unit to the organic light-emitting diode through the switch unit.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
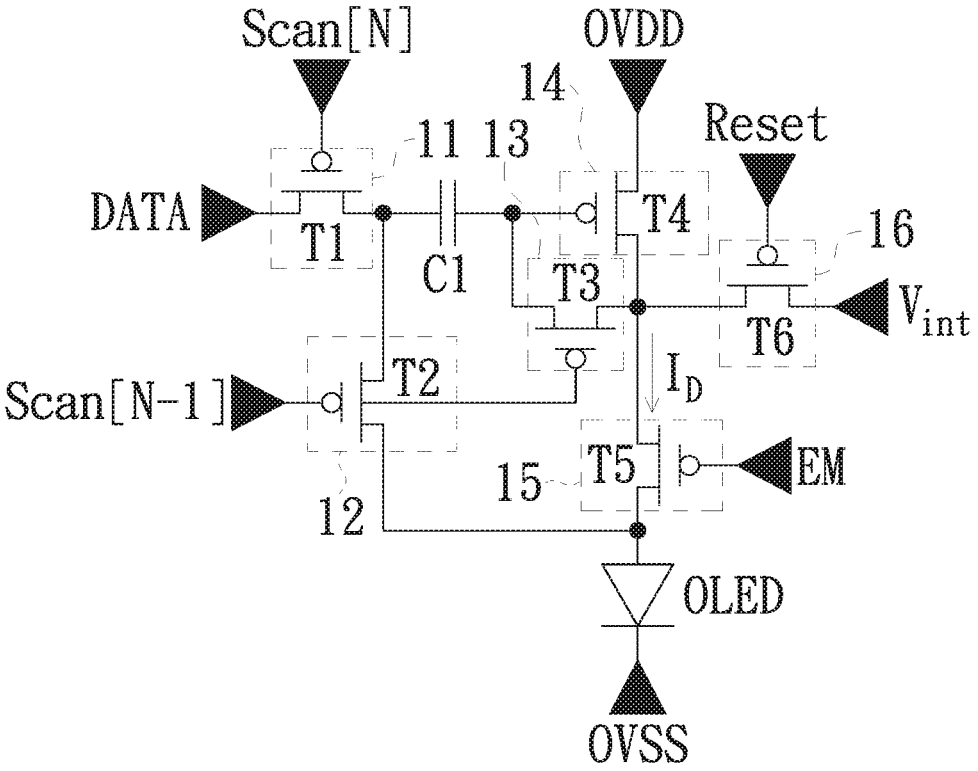
FIG. 1 is a schematic diagram of a pixel circuit in accordance with the first embodiment of the present disclosure.

Please refer to FIG. 1, which is a schematic diagram of a pixel circuit in accordance with the first embodiment of the present disclosure. As shown in FIG. 1, the pixel circuit of the present embodiment includes an input unit 11, a driving unit 14, a first compensation unit 13, a switch unit 15, a second compensation unit 12, a reset unit 16, a capacitor C1 and an organic light-emitting diode OLED.

The input unit 11 may be a transistor such as the transistor T1 in FIG. 1. The transistor T1 has a first terminal, a second terminal and a control terminal. The first terminal of the transistor T1 is for receiving display data DATA; the control terminal of the transistor T1 is for receiving the Nth-stage scan signal Scan[N], wherein N is a positive integer; and the second terminal of the transistor T1 is electrically connected to the second compensation unit 12 and the capacitor C1. The transistor T1 is configured to determine whether to transmit the display data DATA to the second terminal thereof in accordance with the Nth-stage scan signal Scan [N]. The capacitor C1 has a first terminal and a second terminal. The first terminal of the capacitor C1 is electrically connected to the second terminal of the transistor T1; and the second terminal of the capacitor C1 is electrically connected to the first compensation unit 13 and the driving unit 14.

The second compensation unit 12 may be a transistor such as the transistor T2 in FIG. 1. The transistor T2 has a first terminal, a second terminal and a control terminal. The first terminal of the transistor T2 is electrically connected to the second terminal of the transistor T1; the control terminal of the transistor T2 is for receiving the (N−1)th-stage scan signal Scan[N−1]; and the second terminal of the transistor T2 is electrically connected to the organic light-emitting diode OLED. The transistor T2 is configured to determine whether to turn on the channel between the first terminal and the second terminal thereof in accordance with the (N−1) th-stage scan signal Scan[N−1], thereby accordingly changing the voltage at the first terminal of the capacitor C1.

The first compensation unit 13 may be a transistor such as the transistor T3 in FIG. 1. The transistor T3 has a first terminal, a second terminal and a control terminal. The first terminal of the transistor T3 is electrically connected to the second terminal of the capacitor C1; the control terminal of the transistor T3 is for receiving the (N−1)th-stage scan signal Scan[N−1]; and the second terminal of the transistor T3 is electrically connected to the driving unit 14, the switch unit 15 and the reset unit 16. The transistor T3 is configured to determine whether to turn on the channel between the first terminal and the second terminal thereof in accordance with the (N−1)th-stage scan signal Scan[N−1], thereby changing the voltage at the second terminal of the capacitor C1.

The driving unit 14 may be a transistor such as the transistor T4 in FIG. 1. The transistor T4 has a first terminal, a second terminal and a control terminal. The first terminal of the transistor T4 is electrically connected to an external high voltage OVDD; the control terminal of the transistor T4 is electrically connected to the second terminal of the capacitor C1; and the second terminal of the transistor T4 is electrically connected to the second terminal of the transistor T3. The transistor T4 is configured to generate a driving current $I_D$ corresponding to the display data DATA in accordance with the voltage at the second terminal of the capacitor C1.

The organic light-emitting diode OLED has a first terminal and a second terminal. The first terminal of the organic light-emitting diode OLED is electrically connected to the second terminal of the transistor T2 and the switch unit 15; and the second terminal of the organic light-emitting diode OLED is electrically connected to an external low voltage OVSS. The organic light-emitting diode OLED is configured to receive the driving current ID and emit light in accordance with the driving current ID.

The switch unit 15 may be a transistor such as the transistor T5 in FIG. 1. The transistor T5 has a first terminal, a second terminal and a control terminal. The first terminal of the transistor T5 is electrically connected to the second terminal of the transistor T4; the control terminal of the transistor T5 is for receiving a driving control signal EM; and the second terminal of the transistor T5 is electrically connected to the first terminal of the organic light-emitting diode OLED. The transistor T5 is configured to determine that whether the driving current ID passes through the organic light-emitting diode OLED in accordance with the driving control signal EM, so that the organic light-emitting diode OLED can emit light in accordance with the driving current ID.

The switch unit 15 may be a transistor such as the transistor T5 in FIG. 1. The transistor T5 has a first terminal, a second terminal and a control terminal. The first terminal of the transistor T5 is electrically connected to the second terminal of the transistor T4; the control terminal of the transistor T5 is for receiving a driving control signal EM; and the second terminal of the transistor T5 is electrically connected to the first terminal of the organic light-emitting diode OLED. The transistor T5 is configured to determine that whether the driving current $I_D$ passes through the organic light-emitting diode OLED in accordance with the driving control signal EM, so that the organic light-emitting diode OLED can emit light in accordance with the driving current $I_D$.

The reset unit 16 may be a transistor such as the transistor T6 in FIG. 1. The transistor T6 has a first terminal, a second terminal and a control terminal. The first terminal of the transistor T6 is electrically connected to a reference voltage $V_{int}$; the control terminal of the transistor T6 is for receiving a reset control signal Reset; and the second terminal of the transistor T6 is electrically connected to the second terminal of the transistor T4. The transistor T6 is configured to determine whether to output the reference voltage to the second terminal thereof in accordance with the reset control signal Reset, wherein the reference voltage $V_{int}$ is a voltage not lower than a logic-low voltage. The aforementioned transistors in FIG. 1 are exemplified by P-type transistors, but the present disclosure is not limited thereto; namely, the aforementioned transistors in FIG. 1 may be implemented by other types of transistors.

Figure 2:
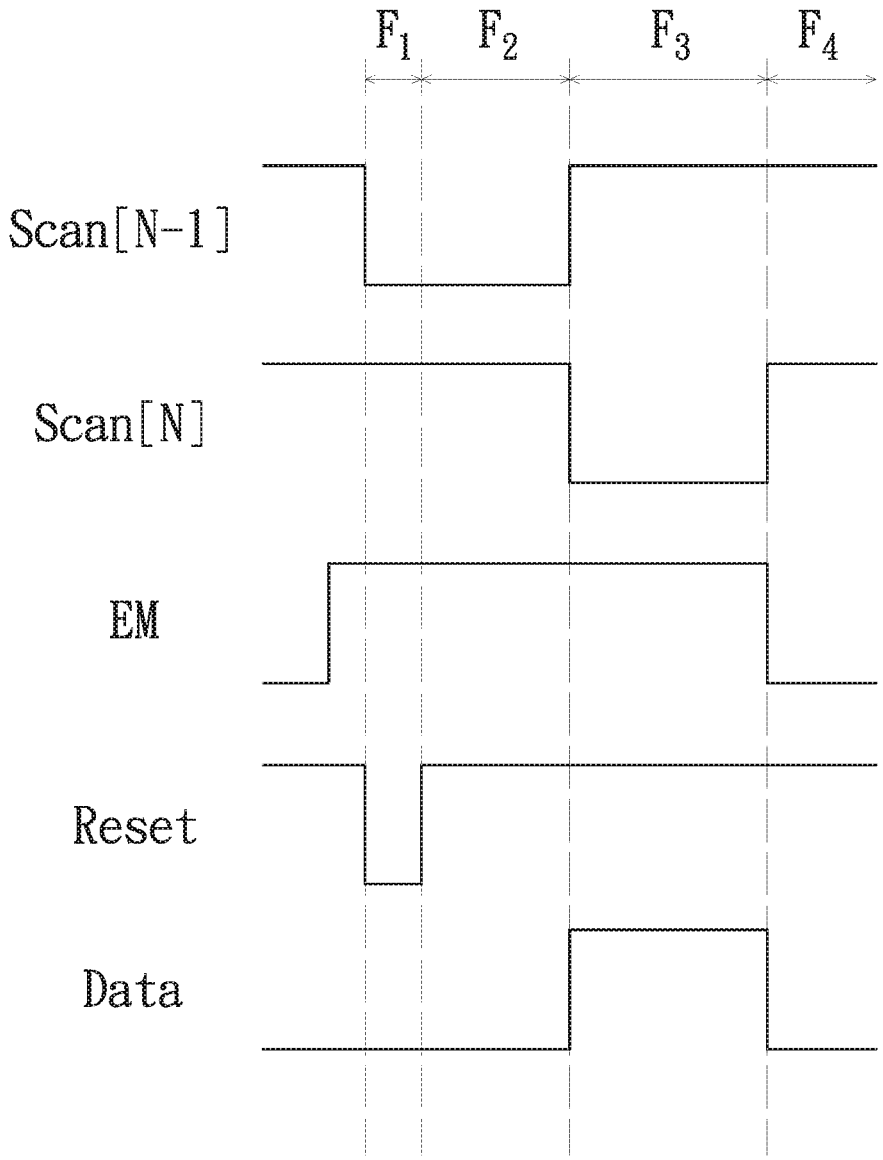
FIG. 2 is a schematic timing diagram of the signals associated with the pixel circuit of FIG. 1.

Then, please refer to FIG. 2, which is a schematic timing diagram of the signals associated with the pixel circuit of FIG. 1. In FIG. 2, the (N−1)th-stage scan signal Scan[N−1], the Nth-stage scan signal Scan[N], the driving control signal EM, the reset control signal Reset and the display data DATA are shown. The operation of the pixel circuit of the present embodiment will be described hereunder with a reference with FIGS. 1 and 2.

First, in a period $F_1$, the (N−1)th-stage scan signal Scan [N−1] is a low voltage (or a logic-low voltage); the Nth-stage scan signal Scan[N] is a high voltage (or a logic-high voltage); the driving control signal EM is a high voltage (or a logic-high voltage); the reset control signal Reset is a low voltage (or a logic-low voltage); and the display data DATA currently has no display content for displaying and accordingly is a low voltage (e.g., 0V). Therefore, in the period $F_1$, the transistors T1 and T5 are turned off and the transistors T2, T3 and T6 are turned on. Specifically, the voltages at the second terminal of the capacitor C1 and the control terminal of the transistor T4 are pulled down to the reference voltage $V_{int}$ due to that the transistors T3 and T6 are turned on; the voltage at the first terminal of the capacitor C1 is pulled down due to the voltage change at the second terminal thereof; the voltage at the first terminal of the organic light-emitting diode OLED is maintained equal to that at the first terminal of the capacitor C1 due to that the transistor T2 is turned on; and although the first terminal and the second terminal of the transistor T4 have a voltage difference $OVDD-V_{int}$ and accordingly the second terminal of the transistor T4 generates a current, there is no current flowing through the organic light-emitting diode OLED due to that the transistor T5 is turned off.

Then, in a period $F_2$, the (N−1)th-stage scan signal Scan[N−1] is a low voltage; the Nth-stage scan signal Scan[N] is a high voltage; the driving control signal EM is a high voltage; the reset control signal Reset is a high voltage (or a logic-high voltage); and the display data DATA currently has no display content for displaying and accordingly has a low voltage. Therefore, in the period $F_2$, the transistors T1, T5 and T6 are turned off and the transistors T2 and T3 are turned on. Specifically, the voltage at the second terminal of the transistor T4 is charged to $OVDD-|V_{th}|$ by the external high voltage OVDD due to that the transistor T6 is turned off, wherein $V_{th}$ is the threshold voltage of the transistor T4; the voltage at the second terminal of the capacitor C1 is charged to $OVDD-|V_{th}|$ through the second terminal of the transistor T4 due to that the transistor T3 is turned on; the voltage at the first terminal of the capacitor C1 is pulled up due to the voltage change at the second terminal of the capacitor C1; because of the transistor T2 is turned on, the voltage at the first terminal of the capacitor C1 is suddenly higher than the voltage at the first terminal of the organic light-emitting diode OLED and consequentially the voltage at the first terminal of the capacitor C1 is pulled down equal to the turn-on voltage $V_{oled}$ of the organic light-emitting diode OLED by the organic light-emitting diode OLED; because of the voltages at the control terminal and the second terminals of the transistor T4 are $OVDD-|V_{th}|$, there is no driving current $I_D$ generated; and because of the transistor T5 is turned off, there is no current flowing through the organic light-emitting diode OLED.

Then, in a period $F_3$, the (N−1)th-stage scan signal Scan[N−1] is a high voltage; the Nth-stage scan signal Scan[N] is a low voltage; the driving control signal EM is a high voltage; the reset control signal Reset is a high voltage; and the display data DATA currently has display contents for displaying and has a display data voltage $V_{data}$. Therefore, in the period $F_3$, the transistors T2, T3, T5 and T6 are turned off and the transistor T1 is turned on. Specifically, the voltage at the first terminal of the capacitor C1 is charged up from the turn-on voltage $V_{oled}$ to the display data voltage $V_{data}$ due to that the transistor T1 is turned on and the display data DATA is the display data voltage $V_{data}$; the voltage at the second terminal of the capacitor C1 is pulled up from $OVDD-|V_{th}|$ to $OVDD-|V_{th}|+(V_{data}-V_{oled})$; and the transistor T4 generates the driving current $I_D$ in accordance with the voltage at the second terminal of the capacitor C1.

Then, in a period $F_4$, the (N−1)th-stage scan signal Scan[N−1] is a high voltage; the Nth-stage scan signal Scan[N] is a high voltage; the driving control signal EM is a low voltage; the reset control signal Reset is a high voltage; and the display data DATA currently has no display content for displaying and accordingly has a low voltage. Therefore, in the period $F_4$, the transistors T1, T2, T3 and T6 are turned off and the transistor T5 is turned on. Specifically, the organic light-emitting diode OLED can receive the driving current $I_D$ generated by the transistor T4 and accordingly emit light due to that the transistor T5 is turned on, wherein the driving current $I_D$ is obtained based on formula: $\frac{1}{2}\times K\times(V_S-V_G-|V_{th}|)^2$, wherein K is a constant, VS is the external high voltage OVDD, $V_G$ is the voltage at the control terminal of the transistor T4, $V_{th}$ is the threshold voltage of the transistor T4, that is, $I_D=\frac{1}{2}\times K\times(OVDD-(OVDD-|V_{th}|+(V_{data}-V_{oled}))-|V_{th}|)^2=\frac{1}{2}\times K\times(V_{oled}-V_{data})^2$. Therefore, the driving current $I_D$ of the pixel circuit of the present disclosure is prevented from being affected by the external high voltage OVDD and the threshold voltage $V_{th}$ of the transistor T4; further, the driving current $I_D$ of the pixel circuit of the present disclosure can be modulated in accordance with the turn-on voltage $V_{oled}$ of the organic light-emitting diode OLED.

Figure 3:
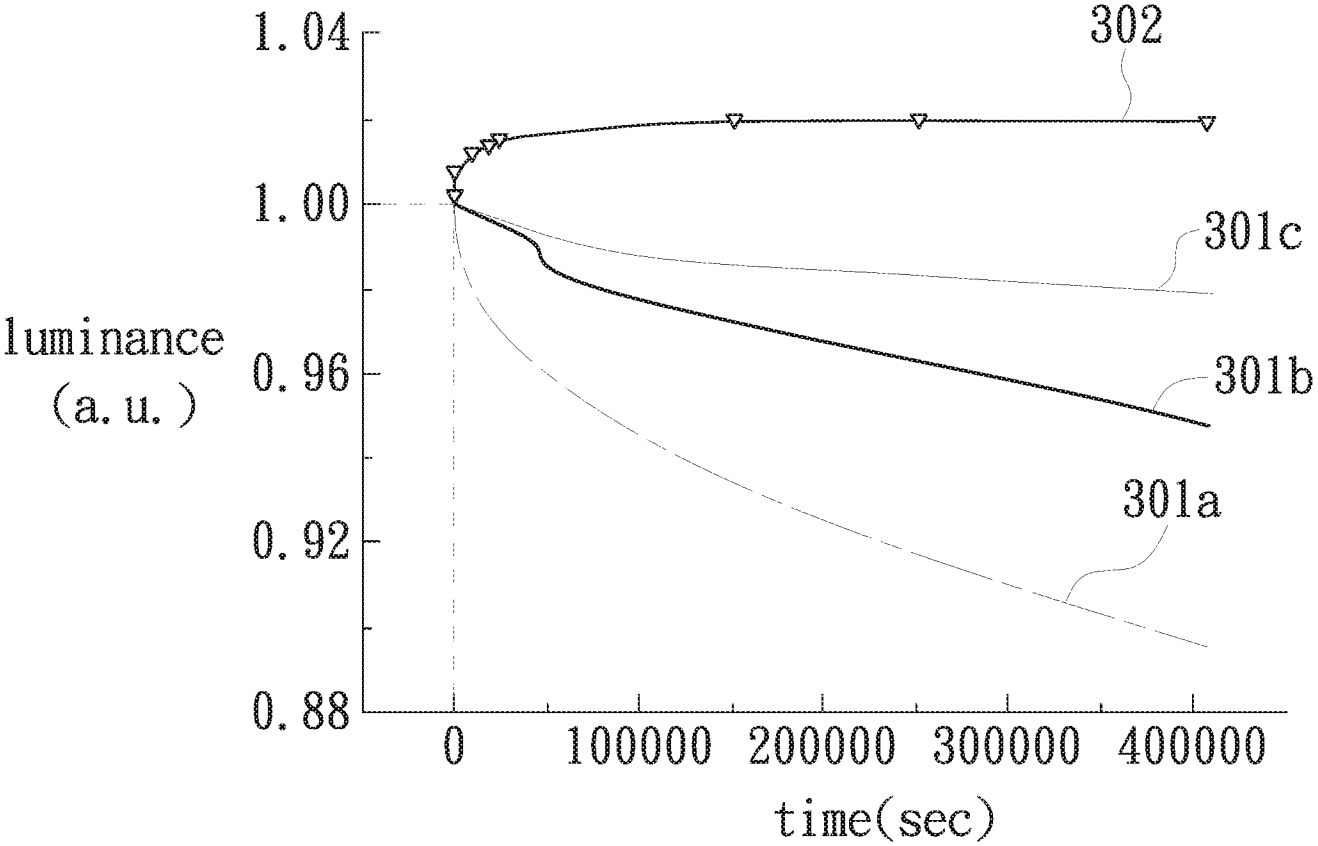
FIG. 3 is a plot of the luminance versus time for a comparison between of the pixel circuits in prior art and the present disclosure.

FIG. 3 is a plot of the luminance versus time for a comparison between of the pixel circuits in prior art and the present disclosure, wherein the initial point of each luminance curve in FIG. 3 start at time 0 and luminance 1.00. In FIG. 3, the luminance curves 301*a*, 301*b* and 301*c* are derived from the pixel circuit in prior art and respectively represent the curves of green G, red R and blue B of the three primary colors RGB; and the luminance curve 302 is derived from the pixel circuit of the present disclosure. As shown in FIG. 3, the pixel circuits in prior art and the present disclosure initially have the same luminance at time 0. However, the luminance curves 301*a*, 301*b* and 301*c* derived from the pixel circuit in prior art decrease significantly over time, which indicates that the pixel circuit in prior art cannot compensate the luminance thereof while the luminance efficiency of the organic light-emitting diode OLED decay over time, and consequentially the luminance of the pixel circuit in prior art decreases over time. On the contrary, the luminance curve 302 derived from the pixel circuit of the present disclosure does not decrease significantly over time, which indicates that the pixel circuit of the present disclosure can compensate the luminance thereof while the luminance efficiency of the organic light-emitting diode OLED decays over time, and consequentially the displaying quality of the pixel circuit of the present disclosure is maintained.

Figure 4A:
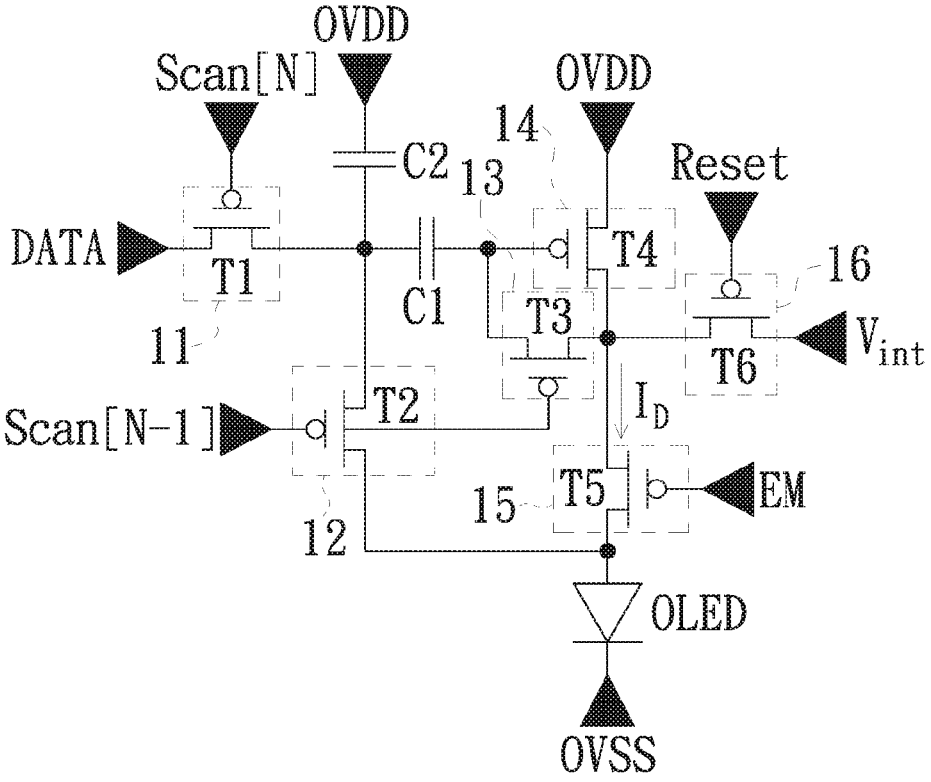
FIG. 4A is a schematic diagram of a pixel circuit in accordance with the second embodiment of the present disclosure.
Figure 4B:
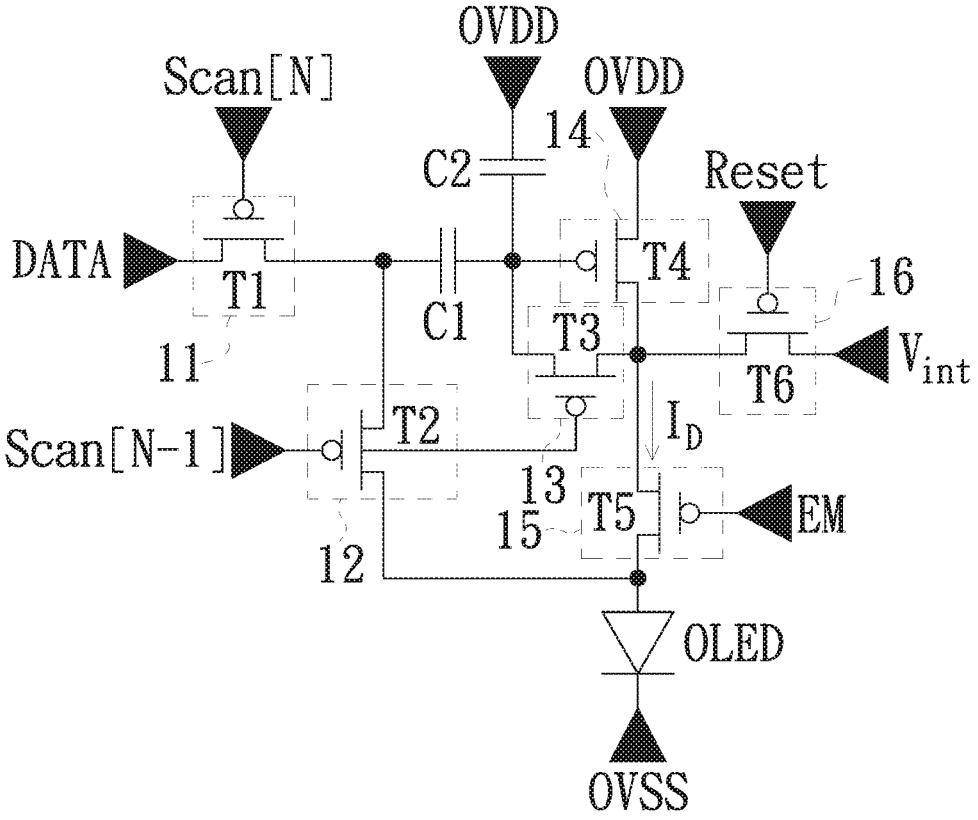
FIG. 4B is a schematic diagram of a pixel circuit in accordance with the third embodiment of the present disclosure.
Figure 4C:
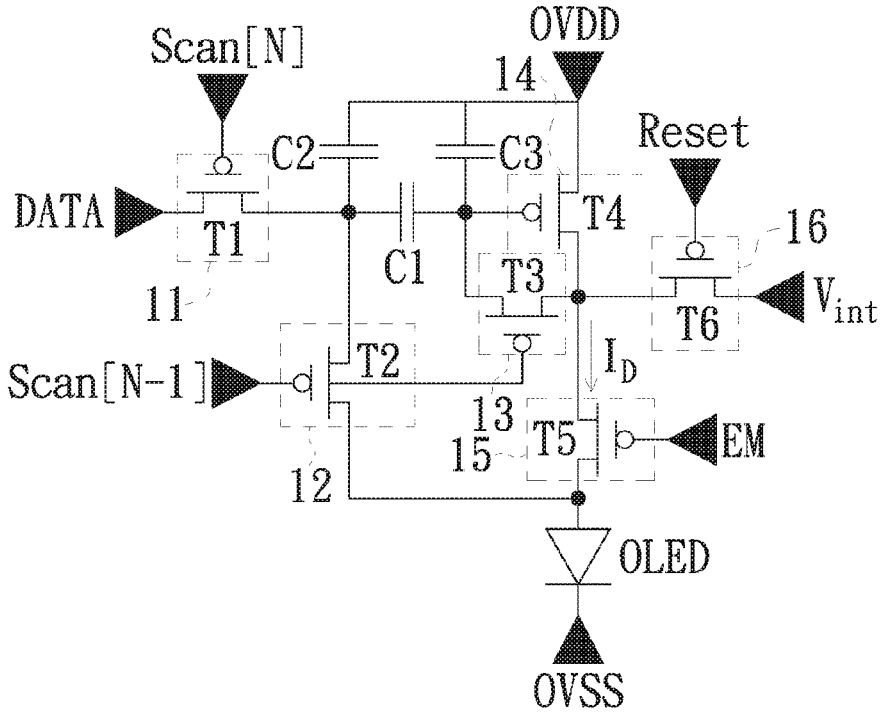
FIG. 4C is a schematic diagram of a pixel circuit in accordance with the fourth embodiment of the present disclosure.

FIG. 4A is a schematic diagram of a pixel circuit in accordance with the second embodiment of the present disclosure. As shown in FIG. 4A, the pixel circuit of the present embodiment is similar to the pixel circuit of FIG. 1. A difference lies in that the pixel circuit of the present embodiment of FIG. 4A further includes a capacitor C2. The capacitor C2 has a first terminal and a second terminal. The first terminal of the capacitor C2 is electrically connected to the external high voltage OVDD; and the second terminal of the capacitor C2 is electrically connected to the second terminal of the transistor T1 and the first terminal of the capacitor C1. In the present embodiment, the capacitor C2 is for enhancing the voltage regulating ability of the pixel circuit. FIG. 4B is a schematic diagram of a pixel circuit in accordance with the third embodiment of the present disclosure. As shown in FIG. 4B, the pixel circuit of the present embodiment is similar to the pixel circuit of FIG. 4A. A difference lies in that the second terminal of the capacitor C2 in the pixel circuit of the present embodiment of FIG. 4B is electrically connected to the control terminal of the transistor T4 and the second terminal of the capacitor C1. Similarly, in the present embodiment, the capacitor C2 is for enhancing the voltage regulating ability of the pixel circuit. FIG. 4C is a schematic diagram of a pixel circuit in accordance with the fourth embodiment of the present disclosure. As shown in FIG. 4C, the pixel circuit of the present embodiment is similar to the pixel circuit of FIG. 4A. A difference lies in that the pixel circuit of the present embodiment of FIG. 4C further includes a capacitor C3. The capacitor C3 has a first terminal and a second terminal. The first terminal of the capacitor C3 is electrically connected to the external high voltage OVDD; and the second terminal of the capacitor C3 is electrically connected to the control terminal of the transistor T4 and the second terminal of the capacitor C1. In the present embodiment, the capacitor C3 is for enhancing the voltage regulating ability of the pixel circuit.

Figure 5:
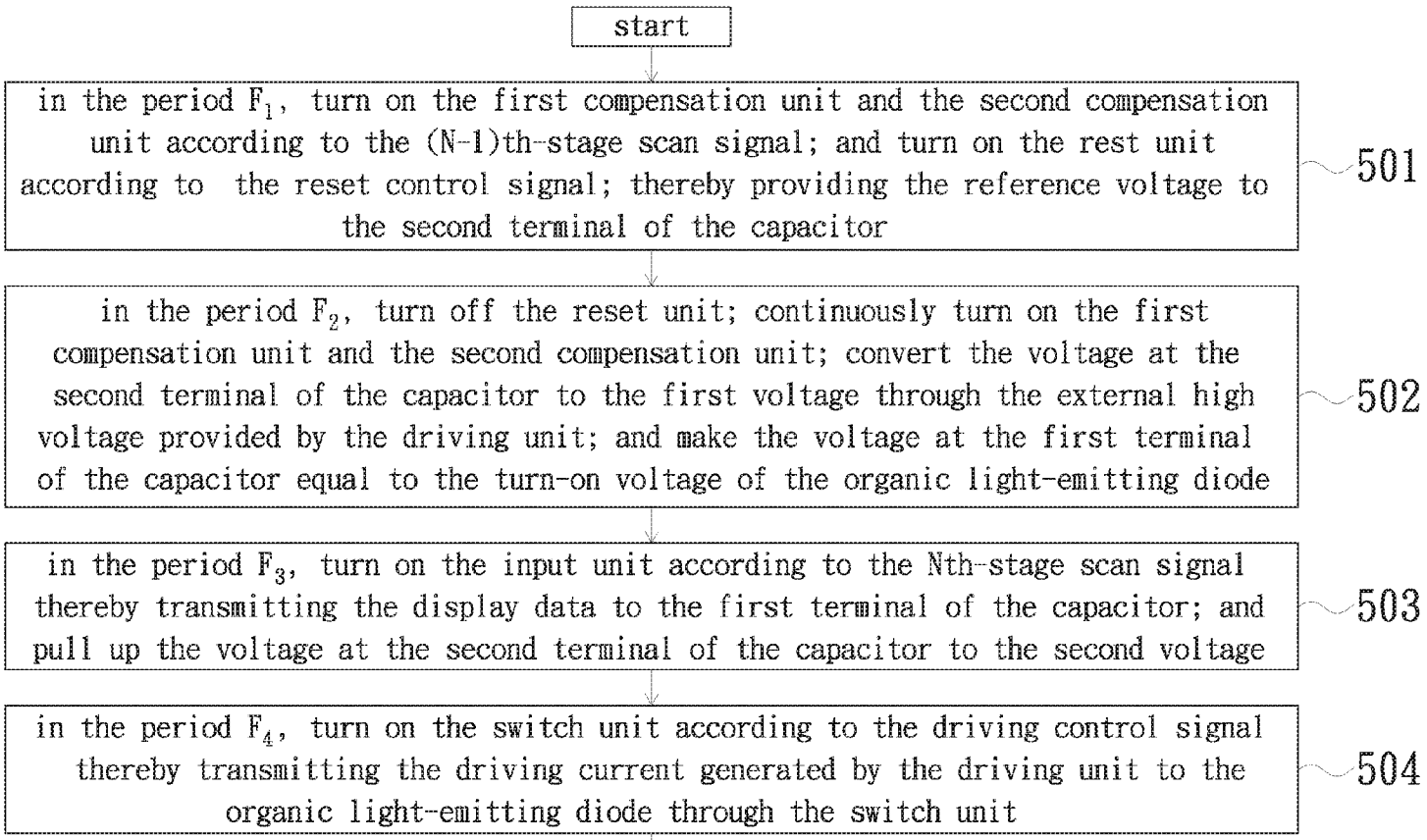
FIG. 5 which is a flow chart of a driving method of a pixel circuit in accordance an embodiment of the present disclosure.

According to the above description, a driving method of pixel circuit is provided in the present disclosure. Please refer to FIG. 5, which is a flow chart of a driving method of a pixel circuit in accordance an embodiment of the present disclosure. As shown in FIG. 5, the driving method of a pixel circuit of the present embodiment includes the following steps. In step 501: when the pixel circuit is operated in the period $F_1$ (e.g., a reset period), the transistors T1 and T5 are turned off according to the first N-level scan signal Scan [N] and the driving control signal EM, respectively; the transistors T2 and T3 are turned on according to the (N−1)th-stage scan signal Scan[N−1]; the transistor T6 is turned on according to the reset control signal Reset; thereby providing the reference voltage $V_{int}$ to the second terminal of the capacitor C1. In step 502: when the pixel circuit is then operated in the period $F_2$ (e.g., a turn-on voltage compensating period), the transistors T1, T5 and T6 are turned off according to the Nth-stage scan signal Scan[N], the driving control signal EM and the reset control signal Reset, respectively; the transistors T2 and T3 are continuously turned on according to the (N−1)th-stage scan signal Scan[N−1]; the voltage at the second terminal of the capacitor C1 is charged to $OVDD-|V_{th}|$ through the transistor T4, wherein $V_{th}$, is the threshold voltage of the transistor T4; and the voltage at the first terminal of the capacitor C1 is pulled down to the turn-on voltage $V_{oled}$ of the organic light-emitting diode OLED through the turned-on transistor T2. In step 503: when the pixel circuit is then operated in the period $F_3$ (e.g., a data writing period), the transistor T1 is turned on according to the Nth-stage scan signal Scan[N] thereby transmitting the display data voltage $V_{data}$ of the display data DATA to the first terminal of the capacitor C1 and also charging the voltage at the second terminal of the capacitor C1 to $OVDD-|V_{th}|+(V_{data}-V_{oled})$; the transistors T2 and T3 are turned off according to the (N−1)th-stage scan signal Scan [N−1]; the transistor T5 is turned off according to the driving control signal EM; and the transistor T6 is turned off according to the reset control signal Reset. In step 504: when the pixel circuit is then operated in the period $F_4$ (e.g., a light-emitting period), the transistor T5 is turned on according to the driving control signal EM thereby making the driving current $I_D$ generated by the transistor T4 flow to the organic light-emitting diode OLED through the turned-on transistor T5; the transistor T1 is turned off according to the Nth-stage scan signal Scan[N]; the transistors T2 and T3 are turned off according to the (N−1)th-stage scan signal Scan [N−1]; and the transistor T6 is turned off according to the reset control signal Reset. In the present embodiment, the driving current $I_D$ is obtained according to the formula:

$$I_D=\tfrac{1}{2}\times K\times(OVDD-(OVDD-|V_{th}|+(V_{data}-V_{oled}))-|V_{th}|)^2=\tfrac{1}{2}\times K\times(V_{oled}-V_{data})^2,$$

therefore, the driving current $I_D$ of the pixel circuit of the present disclosure is prevented from being affected by the external high voltage OVDD and the threshold voltage $V_{th}$ of the transistor T4; further, the driving current $I_D$ of the pixel circuit of the present disclosure can be modulated in accordance with the turn-on voltage $V_{oled}$ of the organic light-emitting diode OLED.

In summary, the pixel circuit of the present disclosure can compensate the threshold voltage $V_{th}$ of the transistor T4 and the external high voltage OVDD in the period $F_2$ and further compensate the turn-on voltage $V_{oled}$ of the organic light-emitting diode OLED in the period $F_3$. Therefore, the operation of the pixel circuit of the present disclosure is prevented from being affected by the threshold voltage $V_{th}$ and the decline of the external high voltage OVDD. Further, the pixel circuit of the present disclosure can provide the corresponding driving current $I_D$ more efficiently according to the change of the turn-on voltage $V_{oled}$ of the organic light-emitting diode OLED. As a result, the organic light-emitting diode OLED can still emit lights normally according to the display data even the luminous efficiency changes and accordingly the issue of deterioration of display quality is avoided.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A pixel circuit, comprising:

a first capacitor, comprising a first terminal and a second terminal;

an input unit, electrically connected to the first terminal of the first capacitor, wherein the input unit is configured to transmit display data to the first terminal of the first capacitor according to a first scan signal;

a driving unit, comprising a first terminal, a second terminal and a control terminal, wherein the control terminal of the driving unit is electrically connected to the second terminal of the first capacitor, and the driving unit is configured to generate a driving current at the second terminal thereof according to a voltage at the second terminal of the first capacitor;

a first compensation unit, electrically connected between the second terminal of the driving unit and the second terminal of the first capacitor, wherein the first compensation unit is configured to convert a first voltage at the second terminal of the first capacitor into a second voltage according to a second scan signal;

an organic light-emitting diode, configured to receive the driving current;

a switch unit, electrically connected between the second terminal of the driving unit and a first terminal of the organic light-emitting diode, wherein the switch unit is configured to transmit the driving current to the organic light-emitting diode according to a first control signal;

a second compensation unit, electrically connected between the first terminal of the first capacitor and the first terminal of the organic light-emitting diode, wherein the second compensation unit is configured to convert a third voltage at the first terminal of the first capacitor into a fourth voltage according to the second scan signal; and a reset unit, electrically connected to the second terminal of the driving unit, wherein the reset unit is configured to provide a reference voltage to the second terminal of the driving unit according to a second control signal, wherein the input unit is a first transistor comprising a first terminal, a second terminal and a control terminal, the first terminal of the first transistor is for receiving the display data, the control terminal of the first transistor is for receiving the first scan signal, and the second terminal of the first transistor is electrically connected to the first terminal of the first capacitor;

wherein the second compensation unit is a second transistor comprising a first terminal, a second terminal and a control terminal, the first terminal of the second transistor is electrically connected to the first terminal of the first capacitor, the control terminal of the second transistor is for receiving the second scan signal, and the second terminal of the second transistor is electrically connected to the first terminal of the organic light-emitting diode;

wherein the first compensation unit is a third transistor comprising a first terminal, a second terminal and a control terminal, the first terminal of the third transistor is electrically connected to the second terminal of the first capacitor, the control terminal of the third transistor is for receiving the second scan signal, and the second terminal of the third transistor is electrically connected to the second terminal of the driving unit;

wherein the driving unit is a fourth transistor; wherein the switch unit is a fifth transistor comprising a first terminal, a second terminal and a control terminal, the first terminal of the fifth transistor is electrically connected to the second terminal of the driving unit, the control terminal of the fifth transistor is for receiving the first control signal, and the second terminal of the fifth transistor is electrically connected to the first terminal of the organic light-emitting diode; and wherein the reset unit is a sixth transistor comprising a first terminal, a second terminal and a control terminal, the first terminal of the sixth transistor is for receiving the reference voltage, the control terminal of the sixth transistor is for receiving the second control signal, and the second terminal of the sixth transistor is electrically connected to the second terminal of the driving unit.

2. The pixel circuit according to claim 1, further comprising:

a second capacitor, comprising a first terminal and a second terminal, wherein the first terminal of the second capacitor is electrically connected to a high voltage and the second terminal of the second capacitor is electrically connected to the first terminal of the first capacitor.

3. The pixel circuit according to claim 1, further comprising:

a second capacitor, comprising a first terminal and a second terminal, wherein the first terminal of the second capacitor is electrically connected to a high voltage and the second terminal of the second capacitor is electrically connected to the second terminal of the first capacitor.

4. A driving method of a pixel circuit, the pixel circuit comprising a first capacitor, an input transistor, a driving transistor, a first compensation transistor, an organic light-emitting diode, a switch transistor, a second compensation transistor and a reset transistor, the input transistor being electrically connected to a first terminal of the first capacitor, the driving transistor being electrically connected to a second terminal of the first capacitor, the first compensation transistor being electrically connected between a second terminal of the driving transistor and the second terminal of the first capacitor, the switch transistor being electrically connected between the driving transistor and the organic light-emitting diode and for receiving a first control signal, the second compensation transistor being electrically connected between the first terminal of the first capacitor and the organic light-emitting diode, the reset transistor being electrically connected to the second terminal of the driving transistor and the first compensation transistor and for receiving a second control signal, the driving method comprising:

in a first period, turning on the first compensation transistor and the second compensation transistor according to a first scan signal and turning on the reset transistor according to the second control signal thereby providing a reference voltage to the second terminal of the first capacitor;

in a second period, turning off the reset transistor, continuously turning on the first compensation transistor and the second compensation transistor, converting a voltage at the second terminal of the first capacitor to a first voltage according to an external high voltage provided by the driving transistor, and making a voltage at the first terminal of the first capacitor equal to a turn-on voltage of the organic light-emitting diode;

in a third period, turning on the input transistor according to a second scan signal thereby transmitting display data to the first terminal of the first capacitor and pulling up the voltage at the second terminal of the first capacitor to a second voltage; and in a fourth period, turning on the switch transistor according to the first control signal thereby transmitting a driving current generated by the driving transistor to the organic light-emitting diode through the switch transistor.

5. The driving method according to claim 4, wherein in the first period, the second scan signal is a low voltage, the first scan signal is a high voltage, the first control signal is the high voltage, and the second control signal is the low voltage; wherein in the second period, the second scan signal is the low voltage, the first scan signal is the high voltage, the first control signal is the high voltage, and the second control signal is the high voltage; wherein in the third period, the second scan signal is the high voltage, the first scan signal is the low voltage, the first control signal is the high voltage, the second control signal is the high voltage, and the display data is a display voltage; wherein in the fourth period, the second scan signal is the high voltage, the first scan signal is the high voltage, the first control signal is the low voltage, and the second control signal is the high voltage.

* * * * *